United States Patent [19]

Geiger et al.

[11] 4,284,301

[45] Aug. 18, 1981

[54] BAG TRANSFER DEVICE

[75] Inventors: Herbert B. Geiger, Bay City; David A. Smith, Midland, both of Mich.

[73] Assignee: The Dow Chemical Company, Midland, Mich.

[21] Appl. No.: 28,633

[22] Filed: Apr. 9, 1979

[51] Int. Cl.[3] ..... B66C 1/42

[52] U.S. Cl. ..... 294/104; 271/268; 294/87 R; 294/88

[58] Field of Search ..... 294/16, 86 R, 87 R, 294/88, 99 R, 99 S, 103 R, 104, 106; 198/650, 653, 695, 479; 271/82, 85, 204–206, 268, 277; 414/30, 740

[56] References Cited

U.S. PATENT DOCUMENTS

| | | | |
|---|---|---|---|
| 1,303,326 | 5/1919 | Jennings | 271/82 |
| 1,337,231 | 4/1920 | Jennings | 271/85 |
| 2,942,719 | 6/1960 | Bofinger et al. | 198/653 |
| 3,305,260 | 2/1967 | Phillips | 294/16 |
| 3,567,270 | 3/1971 | Halberstadt | 294/104 |
| 3,650,217 | 3/1972 | De Rose | 294/103 R |
| 3,960,264 | 6/1976 | Carbine et al. | 294/104 X |

*Primary Examiner*—Johnny D. Cherry

[57] ABSTRACT

Apparatus for clamping and transferring to another location a stack of thermoplastic bags or the like wherein the bag walls have varying thicknesses. The apparatus preferably includes sets of clamping jaws for grasping the stack of bags. Each set comprises two pairs of the jaws. One pair is designed to rigidly clamp upon the stack while the other pair is spring-loaded or otherwise adjustable so that it can close differently than the first pair to compensate for the varying bag thicknesses even when the pairs of jaws are closed by the same drive mechanism. Each set of clamping jaws is independent of the other so that they can operate independently if one set were to jam.

7 Claims, 5 Drawing Figures

BAG TRANSFER DEVICE

FIELD OF THE INVENTION

The present invention relates generally to the field of transferring thermoplastic bags or other products from one location to another for purposes of packaging of the same.

DESCRIPTION OF THE PRIOR ART

The present invention is particularly concerned with a device adaptable to transferring stacks of bags of varying thicknesses from one location to another for packing into cartons or for other purposes. The prior art has failed to provide a means for adequately compensating for varying bag wall thicknesses in transfer devices. This becomes a particular problem in transferring bags having integral closures such as those found in Ziploc® brand bags manufactured by The Dow Chemical Company, for example. In such bags the wall thickness increases towards the zipper element. By failing to compensate for the thickness variation jamming was not uncommon in prior art devices. Furthermore, such jamming resulted in entire shut down of the apparatus because the different sets of clamping mechanisms were commonly operated.

SUMMARY OF THE INVENTION

The present invention involves a device for transferring a plurality of bags with varying wall thicknesses in a stack or other products of varying thickness. The device has clamping jaws which work cooperatively with an adjustment mechanism to compensate automatically for the varying wall thickness. Each set of clamping jaws includes a non-adjusting pair of jaws and an adjusting pair of jaws. In one preferred embodiment the adjusting jaws clamp tighter than the non-adjusting jaws so that when the non-adjusting jaws clamp the thicker portion of a bag stack, the adjusting jaws automatically tighten on the thinner portion of the stack. Such an arrangement could be reversed. For example, the non-adjusting jaws could clamp on the thinner portion of the bag stack and the adjusting jaws could open sufficiently to take in the thicker wall portion of the bag stack. The device preferably includes separate sets of jaws so that if one set of jaws is jammed the device can continue to operate to transfer another stack of bags with the other set or sets. Each set of clamping jaws is able to secure the bags and then by other means move the stack to another location.

The present invention may be better understood by reference to the following description taken in connection with the accompanying drawings in which like reference characters refer to like elements in the several views.

DETAILED DESCRIPTION OF THE PREFERRED EMBODIMENT

Figure 1:
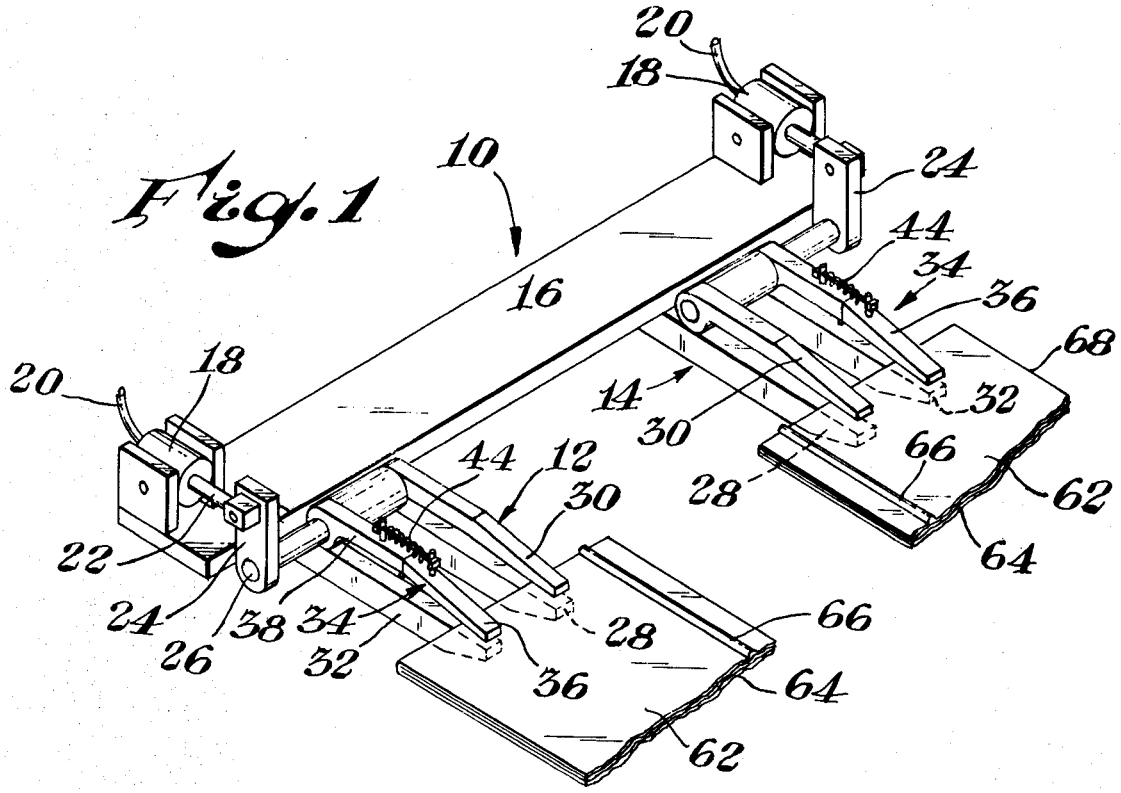
FIG. 1 is an isometric view of a pair of clamping jaw sets according to the present invention, each set carrying a stack of bags.

Referring more particularly to FIG. 1, there is shown a bag transfer device 10 having a pair of clamping jaw sets 12 and 14 supported on the left and right, respectively, from support bar 16. Bar 16 can be moveable backwards and forwards in a horizontal or other plane to effect bag transfer. Each clamping jaw set 12 and 14 is adapted to hold a stack of plastic bags as they are moved from one location, i.e. that shown, to another location (not shown). Each clamping jaw set is shown operated by a pneumatic or hydraulic system 18 connected by line 20 to a fluid input (not shown). Each cylinder 18 moves arm 22 inwardly and outwardly to turn arm 24 pivotly about shaft 26 to raise and lower and open and close each clamping jaw set 12 or 14. Instead of pneumatic or hydraulic system 18, the same effect may possibly be achieved by a solenoid actuated lever or a mechanical cam system.

Each set 12 and 14 can be operated separately from the other so that if one becomes inoperable the other can still function. Entire device 10 can be mounted in a line for making, sealing and packing of bags in order to assist in moving the bags from one location to another. The particular association of the device 10 with the rest of the apparatus is not revelant to the functioning of the clamping and transfer system, which can find use in various different systems.

For purposes of this specification, description of clamping jaw set 12 will be made with the understanding that clamping set 14 is identical therewith except that the arrangement of the jaws as shown is reversed to that of clamping jaw set 12. Clamping jaw set 12 includes a non-adjustable pair of jaws 28 and 30 and an adjustable pair of jaws 32 and 34. Jaws 28 and 32 are lower jaws and jaws 30 and 34 are upper jaws as viewed in FIG. 1. Jaws 28, 30 and 32 are each of one piece. However, jaw 34 is formed of two components in the preferred embodiment, a forward component 36 and a rearward component 38 which are hingedly connected to one another by a pivot pin 40. Forward component 36 and rearward component 38 each carry a post or equivalent means 42 between which is secured a compression means or loaded spring 44 which causes the two posts to be pushed apart in a manner so that the front arm 36 of jaw 34 is, in the embodiment shown, downwardly biased against the top surface of fixed jaw 32. Preferably, the loaded spring 44 is carried by a headed bolt 43 with a lock nut 45, to limit downward movement of arm 36. In this case, the aperture 47 in the forward post on arm 36 can be oversized to permit pivoting on the bolt shaft. Instead of a rigid bolt, a flexible cable or other equivalent means could be used and still achieve the limited arm movement control accomplished by the bolt and nut arrangement shown.

Figure 3:
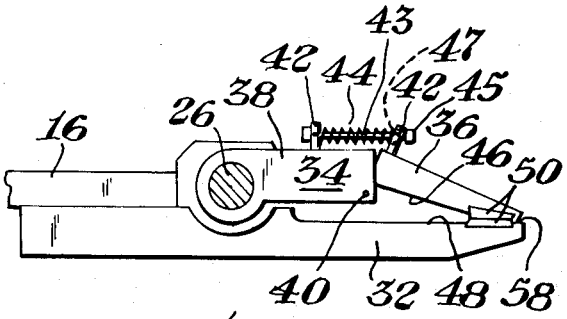
FIG. 3 is a side elevational view taken along the line 3—3 of FIG. 2 showing the left-most adjustable clamping jaw pair.

As more clearly shown in FIG. 3, the inner surface 46 of arm 36 and the inner surface 48 of jaw 32 each have cutouts to carry clamping pads 50. These pads can be formed of Number 70 Durometer Silicone rubber so that they can releasably secure a stack of thermoplastic bags therebetween. The loaded spring 44 forces the bags to be secured between the opposing pads 50 in FIG. 3. The shaft 26 is rotated clockwise to close simultaneously the opposing jaws of each pair in the set. However, it can be appreciated that separate drive means could be used for each pair of jaws should that be desired.

Figure 2:
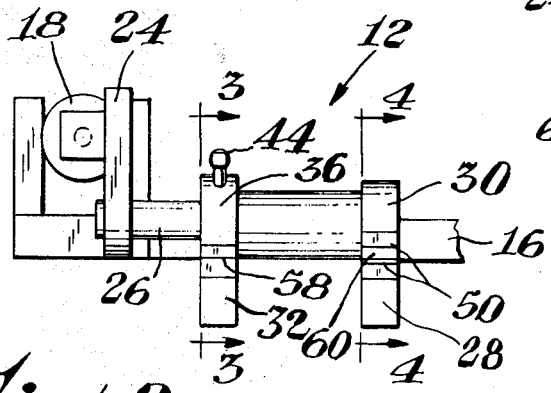
FIG. 2 is a fragmentary front elevationalview of the clamping jaw set as seen to the left of FIG. 1 only without bags therein, shown just as the adjustable pair of jaws meet.
Figure 4:
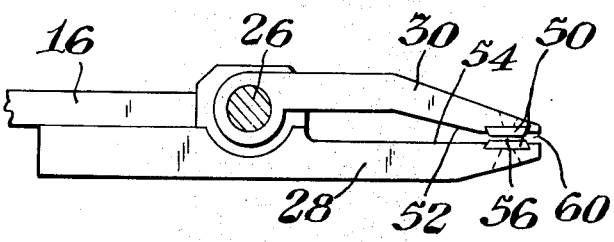
FIG. 4 is a side elevational view taken along the line 4—4 of FIG. 2 showing the non-adjustable clamping jaw pair.

FIG. 4 shows clamping jaws 28 and 30 which are each of a single piece, i.e., non-self adjustable as are the jaws 32 and 34. This pair of jaws 28 and 30 is also closed by action of rotating shaft 26 with the same action from cylinder 18 which closes the jaws 32 and 34. However, in the case of the pair of jaws 28 and 30, the pads 50 located on the undersides 52 and 54 of jaws 28 and 30 are spaced so as to leave a gap 60 therebetween of sufficient width to allow a stack of bags to be placed and secured therebetween. As can be seen in FIG. 2, when the clamping jaws 28 and 30 are closed but empty, pads 50 carried by these jaws meet at line 58. The clamping jaw component 36 is set so that it is lower than fixed jaw 30 such that when, for example, it touches its lower jaw 32, jaw component 36 does so before jaw 30 would touch its lower jaw 28, resulting in a gap 60. Because of this relationship, a pressure against the bags between jaws 32 and 34 is assured when jaws 28 and 30 are closed upon a stack of bags as shown in FIG. 5.

Figure 5:
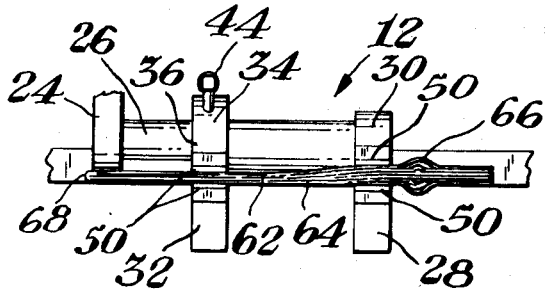
FIG. 5 is a fragementary front elevational view like FIG. 2 only showing the clamping jaws in operation securing a stack of bags having uneven wall thicknesses.

As seen both in FIGS. 1 and 5, a plurality of stacked bags 62 are secured between the jaws forming clamping sets 12 and 14. In the preferred embodiment, stack of bags 62 is made up of individual bags 64 which have an integral closure 66 located adjacent one end thereof. Such bags can be of the type shown in U.S. Pat. No. 3,198,288 to Kakuji Naito, Aug. 3, 1965. Because of integrally extruded closure 66, the bag walls become thicker and the resultant stack becomes thicker adjacent the closure end of the bag. Therefore, when each clamp set operates, it is designed to function so that it can accommodate automatically the varying thickness of the bag wall as it varies from the bottom end 68 of a bag to its top end adjacent integral closure 66. These varying thicknesses are shown exaggerated in FIG. 5. It can readily be seen that in this embodiment, the thicker bag portion or section adjacent zipper 66 is grasped between non-adjustable jaws 30 and 28 and the thinner bag portion or section of the stack of bags 62 is grasped between the jaw 32 and the front arm 36 of jaw 34.

In operation, a stack 62 of bags 64 is placed upon fixed lower jaws 28 and 32 and the cylinder 18 is actuated. Upon such actuation, upper jaw 30 securely clamps the thicker section of the bags in the stack 62 securely therebetween and, at the same time, arm 36 of jaw 34 is brought down upon the bags resting on jaw 32. However, instead of jaws 32 and 34 closing completely as they do in FIG. 2 where there are no bags therebetween, arm 36 is biased upwardly to securely contain the stack 62 therebetween, as illustrated in FIG. 5. The spring-loaded arm 36 exerts sufficient pressure to secure the bags between the clamping jaws 32 and 34 and automatically adjusts, because of the spring-loading, to the thinner wall thickness of the stack of bags at that clamping point. Therefore, the system automatically adjusts for the varying thickess of the stack of bags as is desirable for any given significant difference in bag wall thickness.

As another embodiment, it is possible to reverse the stacking of the bags in the clamping jaw set so that the thicker portion of the bags is found between the adjustable clamping jaws and the thinner portion of the stack is found between the pair of clamping jaws 28 and 30. In such case the jaws 28 and 30 would clamp tight on the thin wall section and the adjustable arm 36 of jaw 34 would be biased upwardly even further from the jaw 32 to compensate for the thicker section of the bag stack located therebetween. This and other embodiments or modifications of the present invention are possible and can still be within the scope of the invention. For example, the amount of spring-loading and the size of the gap 60 can be made to accommodate various desired conditions. The materials used in constructing the different mechanisms can be of steel or other metals or of various functionally satisfactory plastic materials without affecting the concept of the invention.

What is claimed as new is:

1. A device for clamping and transferring products of varying wall thicknesses comprising a pair of clamping jaw assemblies, one of said assemblies comprising a first jaw and a second jaw, means for driving said first jaw a given distance towards but fixedly spaced from the second jaw to clamp one thickness of said products, the other one of said assemblies comprising a first jaw and a second jaw, means for automatically biasly adjusting the second jaw of said other one of said assemblies towards the first jaw thereof and approaching a closed position therewith to clamp a thickness of said products different than said one thickness, said second adjustable jaw being flexible from said position so as to accommodte said different wall thicknesses of said products located between the jaws of said other one of said assemblies.

2. The device of claim 1 wherein the first jaw of both assemblies is fixed and the adjustable second jaw of the other one of said assemblies is comprised of forward and rearward components pivotally connected to one another, said components being spring-loaded against one another so that the forward component thereof is biased towards the fixed lower jaw forming the assembly.

3. The device of claim 1 wherein each of the jaws includes a non-metallic resilient pad for securing products therebetween.

4. The device of claim 1 wherein said device includes a second pair of clamping jaw assemblies like said first-mentioned pair of clamping jaw assemblies, said first-mentioned pair of clamping jaw assemblies is separated from said second pair of clamping jaw assemblies so that failure of one of such assemblies does not impede operation of the other of such assemblies.

5. The device of claim 1 wherein the biasing means includes means to limit the movement of the adjustable second jaw towards the first jaw in said other one of said assemblies.

6. A plurality of products of varying wall thickness sections contained within a device for clamping and transferring the products, said device comprising a pair of clamping jaw assemblies, one of said assemblies comprising a non-self-adjustable first jaw and a second jaw, means for driving said first jaw towards but spaced from the second jaw, a first thickness section of said products being clamped between said first and second jaws of such one of said assemblies, the other one of said assemblies comprising a first jaw and a second jaw, means for automatically biasly adjusting the second jaw of said other one of said assemblies towards the first jaw thereof and approaching a closed position therewith, a second thickness section of said products thinner or thicker than said first thickness section being clamped between said first and second jaws of such other one of said assemblies, said second adjustable jaw being flexible from said position so as to accommodate the second thickness of such products located between the jaws of said other one of said assemblies.

7. The plurality of products and device of claim 6 wherein the first jaw of both assemblies are fixed and the adjustable second jaw of the other one of said assemblies is comprised of forward and rearward components pivotally connected to one another, said components being spring-loaded against one another so that the forward component thereof is self-biased towards the fixed lower jaw forming the assembly, said device including a second pair of clamping jaw assemblies like said first-mentioned pair of clamping jaw assemblies, and means for independently operating each pair of clamping jaw assemblies so that accommodation of the varying product thicknesses is made.

* * * * *